US006925928B2

(12) United States Patent
Fox

(10) Patent No.: US 6,925,928 B2
(45) Date of Patent: Aug. 9, 2005

(54) TRASH COMPACTOR FOR FAST FOOD RESTAURANT WASTE

(76) Inventor: Anthony Fox, 8306 Queen Ave. South, Minneapolis, MN (US) 55421

( * ) Notice: Subject to any disclaimer, the term of this patent is extended or adjusted under 35 U.S.C. 154(b) by 0 days.

(21) Appl. No.: 10/666,110

(22) Filed: Sep. 18, 2003

(65) Prior Publication Data

US 2005/0061167 A1 Mar. 24, 2005

(51) Int. Cl.[7] ..... B30B 15/06

(52) U.S. Cl. ..... 100/48; 100/99; 100/215; 100/229 A; 100/233; 100/288; 100/345

(58) Field of Search ..... 100/48, 49, 52, 100/99, 215, 229 A, 233, 262, 266, 295, 100/288, 345, 269.17, 219; 220/908

(56) References Cited

U.S. PATENT DOCUMENTS 2,757,603 A * 8/1956 Alexander et al. ..... 100/226
3,611,951 A * 10/1971 Sloan ..... 425/151
3,838,635 A * 10/1974 Hardy ..... 100/215
4,130,054 A * 12/1978 Tashman ..... 100/52
4,552,061 A * 11/1985 Brutsman ..... 100/343
4,944,220 A 7/1990 Fox
5,012,732 A 5/1991 Fox
5,517,907 A 5/1996 Fox
6,367,377 B1 * 4/2002 Gawley et al. ..... 100/49

OTHER PUBLICATIONS

Smart Pack Automatic Compacting Receptacle manual for model SP30, Harmony Enterprises, Inc. Mar. 20, 2001.*

* cited by examiner

*Primary Examiner*—Derris H Banks
*Assistant Examiner*—Jimmy T Nguyen
(74) *Attorney, Agent, or Firm*—Nikolai & Mersereau, P.A.

(57) ABSTRACT

A refuse compactor especially designed for use in fast-food restaurant environments includes a hydraulic pump driven by an electric motor for actuating a hydraulic ram to compress restaurant waste materials. The compactor includes a unique compaction plate assembly that maintains the platen inclined at a predetermined angle to the vertical when the platen is elevated and which forces the platen to a horizontal disposition during a downward compaction stroke. A motor operated closure member selectively blocks and unblocks a refuse-receiving opening formed in a front door of the compactor unit and with a motion detector controlling the opening and closing of the refuse entry door panel.

13 Claims, 7 Drawing Sheets

TRASH COMPACTOR FOR FAST FOOD RESTAURANT WASTE

BACKGROUND OF THE INVENTION

I. Field of the Invention

This invention relates generally to equipment for compacting waste material, and more particularly to the design of a trash compactor for use in fast food restaurants and other food vending establishments where the patron is expected to deposit his/her waste paper products in a trash receptacle upon leaving the establishment.

II. Discussion of the Prior Art

Many fast food restaurants and cafeterias typically provide a refuse or waste container near the exit doors of the establishment and at other convenient locations so that at the conclusion of a meal, the patron's tray containing napkins, paper cups, food wrappers, placemats, etc. can be dumped into the waste receptacle by the patron rather than by restaurant staff. However, it is up to the restaurant staff to periodically empty these trash receptacles, bag the waste materials in polyethylene bags and then deposit the bagged waste in a dumpster for pick-up by a refuse removal service.

Because the waste material is merely allowed to fall by gravity in the conventional waste receptacles currently used, it is not particularly dense and frequent emptying of the waste receptacles by staff personnel is required to prevent overflow and attendant lack of patron compliance. The need to frequently empty the refuse receptacles can be a significant cost item for a restaurant operation. Moreover, since refuse haulers generally charge by volume and not by weight, bagged, loosely-compacted refuse takes up an inordinate amount of space in a dumpster and also adds to the cost of refuse disposal.

A need, therefore, exists for a refuse compactor capable of compressing fast food restaurant trash so that less frequent emptying is required and a greater mass of waste material can be contained in a smaller volume. The present invention provides a unique solution to this problem.

SUMMARY OF THE INVENTION

In accordance with the present invention, there is provided a refuse compactor especially designed for use in a restaurant facility that comprises a frame having a horizontal, rectangular base and a pair of upwardly extending structural members affixed to the base along opposed side edges thereof. Extending across the structural members at the top thereof is a horizontal cross member. Further supported by the frame is a compaction plate assembly that includes a one-piece platen pivotally affixed to a support member for rotation about a horizontal axis, a hydraulic ram that is operatively disposed between the horizontal cross member of the frame and the support member for driving the compaction plate in a vertical direction toward and away from the base and a pair of guide rods for maintaining alignment of the assembly during its operational stroke. Biasing springs are disposed between the support member and the platen for urging the platen from a first position that is inclined to the vertical to a second horizontal position during a downward movement of the compaction plate assembly when the hydraulic ram is actuated. On a return stroke of the compaction plate assembly, the platen is returned to its inclined position.

The refuse compactor has decorative sidewalls mounted in surrounding relation to the frame and includes a door at a front thereof which can be opened to withdraw a wheeled cart containing compacted trash. Formed through the door is a refuse receiving opening and mounted relative to the opening is a hinge panel that is pivotable about a horizontal axis for selectively blocking the refuse-receiving opening. In that the compaction plate is inclined to the vertical when its raised disposition, it does not interfere with the opening of the hinged panel by a patron wishing to deposit refuse into the compactor. Means are provided for automatically swinging the hinged panel to its open position upon detection of the approach of a patron toward the compactor.

DESCRIPTION OF THE DRAWINGS

The foregoing features, objects and advantages of the invention will become apparent to those skilled in the art from the following detailed description of a preferred embodiment, especially when considered in conjunction with the accompanying drawings in which like numerals in the several views refer to corresponding parts.

DESCRIPTION OF THE PREFERRED EMBODIMENT

Figure 1:
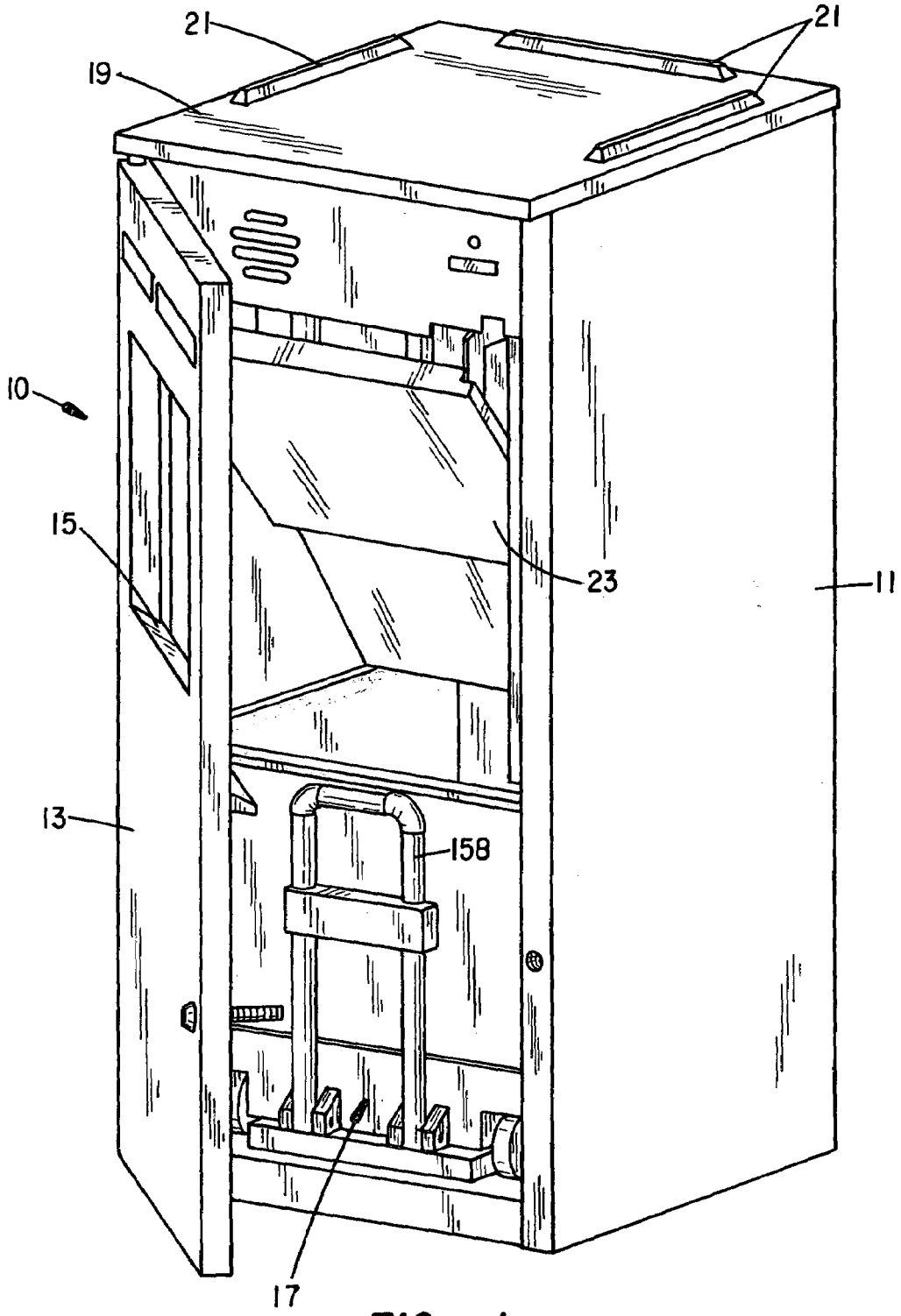
FIG. 1 is an isometric view of the trash compactor comprising a preferred embodiment of the present invention.

Certain terminology will be used in the following description for convenience in reference only and will not be limiting. The words "upwardly", "downwardly", "rightwardly" and "leftwardly" will refer to directions in the drawings to which reference is made. The words "inwardly" and "outwardly" will refer to directions toward and away from, respectively, the geometric center of the device and associated parts thereof. Said terminology will include the words above specifically mentioned, derivatives thereof and words of similar import.

Shown in FIG. 1 is an isometric view of a trash compactor specifically designed for use in fast food restaurants. It is indicated generally by number 10. In this figure, decorative plastic skins 11 form an enclosure having a pair of sidewalls joined to one another by a rear wall that are in place on the machine. A door 13 forms a front of the enclosure. It has an opening 15 through which restaurant waste or the like can be deposited, the waste is adapted to fall into a polyethylene refuse bag (not shown) used to line the box 156 of a removable cart assembly 17 when the door 13 is closed and locked. A removable plastic top panel 19 is attached that has upwardly projecting ribs adjacent the side and rear perimeters of the top panel. The space between these ribs provides a convenient place for serving trays to be stacked once the waste has been deposited into the cart 17 through the opening 15.

During use, the door 13 will be closed and locked. The door is only open to remove the cart 17 once it is filled with compacted waste material. A motor-operated hinged panel 23 normally blocks the opening 15, but swings to an open position when a proximity sensor detects the approach of a patron. an audio message is also played. The manner in which this is accomplished will be explained in considerably more detail as the description of the preferred embodiment continues.

Figure 2:
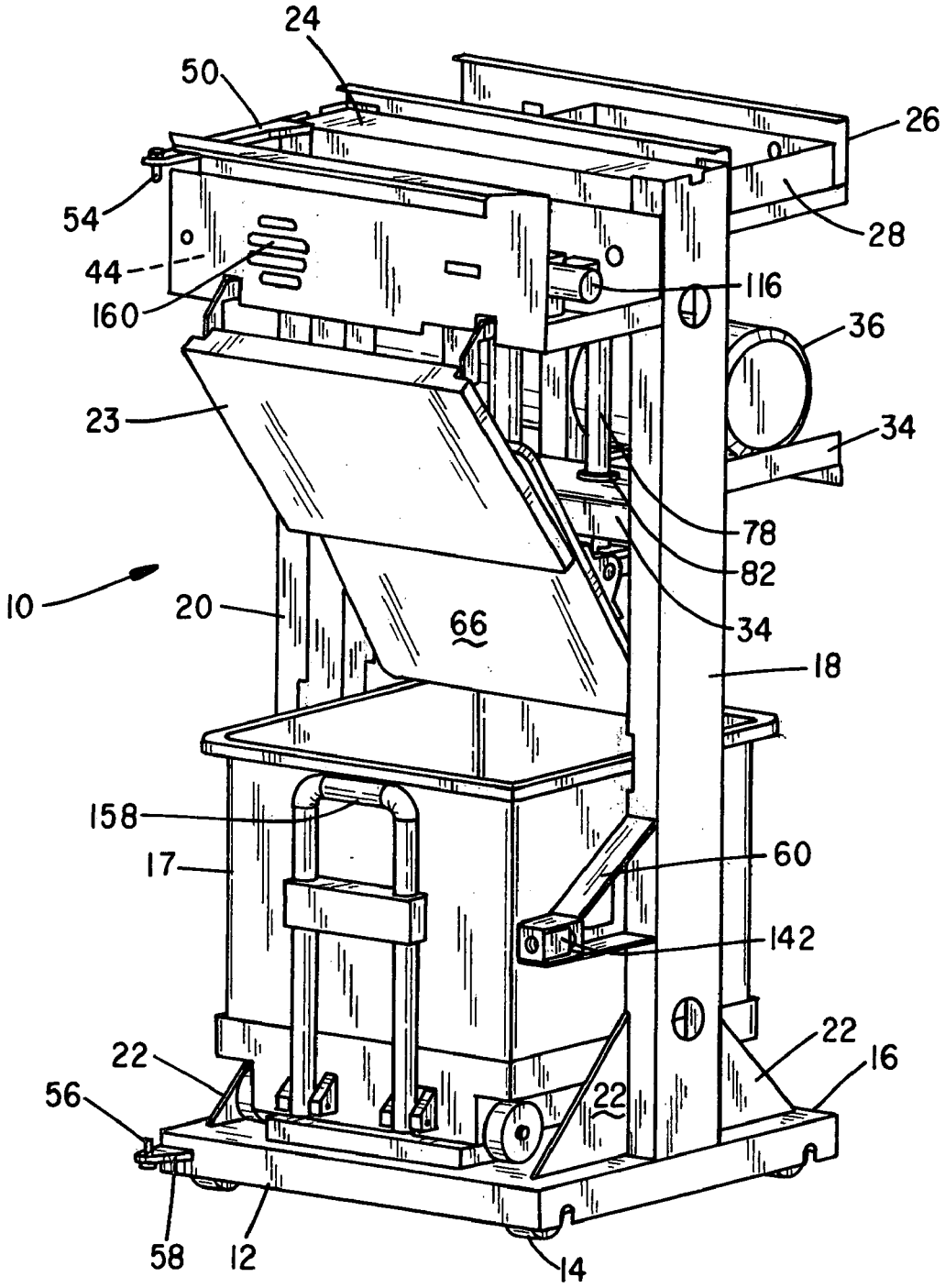
FIG. 2 is an isometric view from the front and right side of the trash compactor of FIG. 1, but with the decorative outer skins removed to show the internal construction.

Referring then to FIG. 2, there is shown a front isometric view of a waste compactor constructed in accordance with the present invention, it is indicated generally by numeral 10 and, for clarity, the outer skins 11 are removed to better illustrate the machine's internal parts. The framework for the compactor includes a flat, generally rectangular steel base 12 that is mounted on four caster wheels, as at 14, to facilitate moving and positioning of the compactor. Welded to the upper surface 16 of the base 12 midway along its opposed sides are upwardly extending structural members here shown as vertically oriented steel channels 18 and 20. These heavy gauge steel channels are further supported by triangular steel gussets 22 that are welded both to the top surface 16 of the base 12 and to the respective vertical channels 18 and 20. Extending between the upper ends of the vertical channels 18 and 20 is a horizontal cross member, here shown as a steel top channel 24 that is also welded in place.

Figure 3:
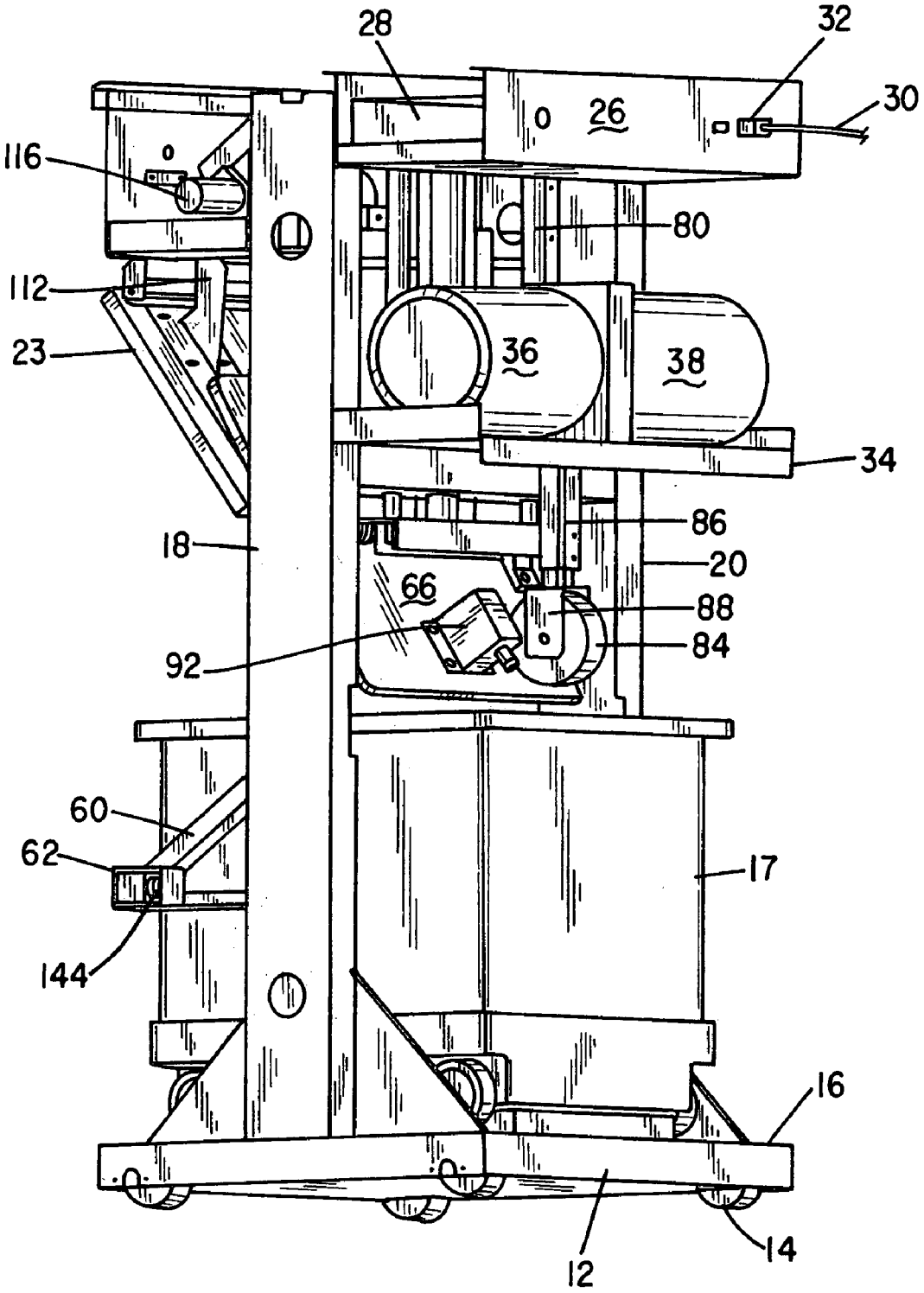
FIG. 3 is an isometric view like that of FIG. 2, but taken from the rear and right side.

As can be seen in FIG. 3, there is welded to the rear edges of the vertical channels 18 and 20 proximate the upper end thereof a steel tray on which is supported an electronic control board assembly 28. Electrical power is delivered to the compactor 10 by way of a power cord 30 that is adapted to plug into a connector 32 on the rear of the tray 26.

Disposed below the tray 26 and also welded to the vertical channels 18 and 20 is a support plate 34 on which is mounted an electric motor 36 that is coupled in driving relation to a hydraulic pump 38.

Figure 4:
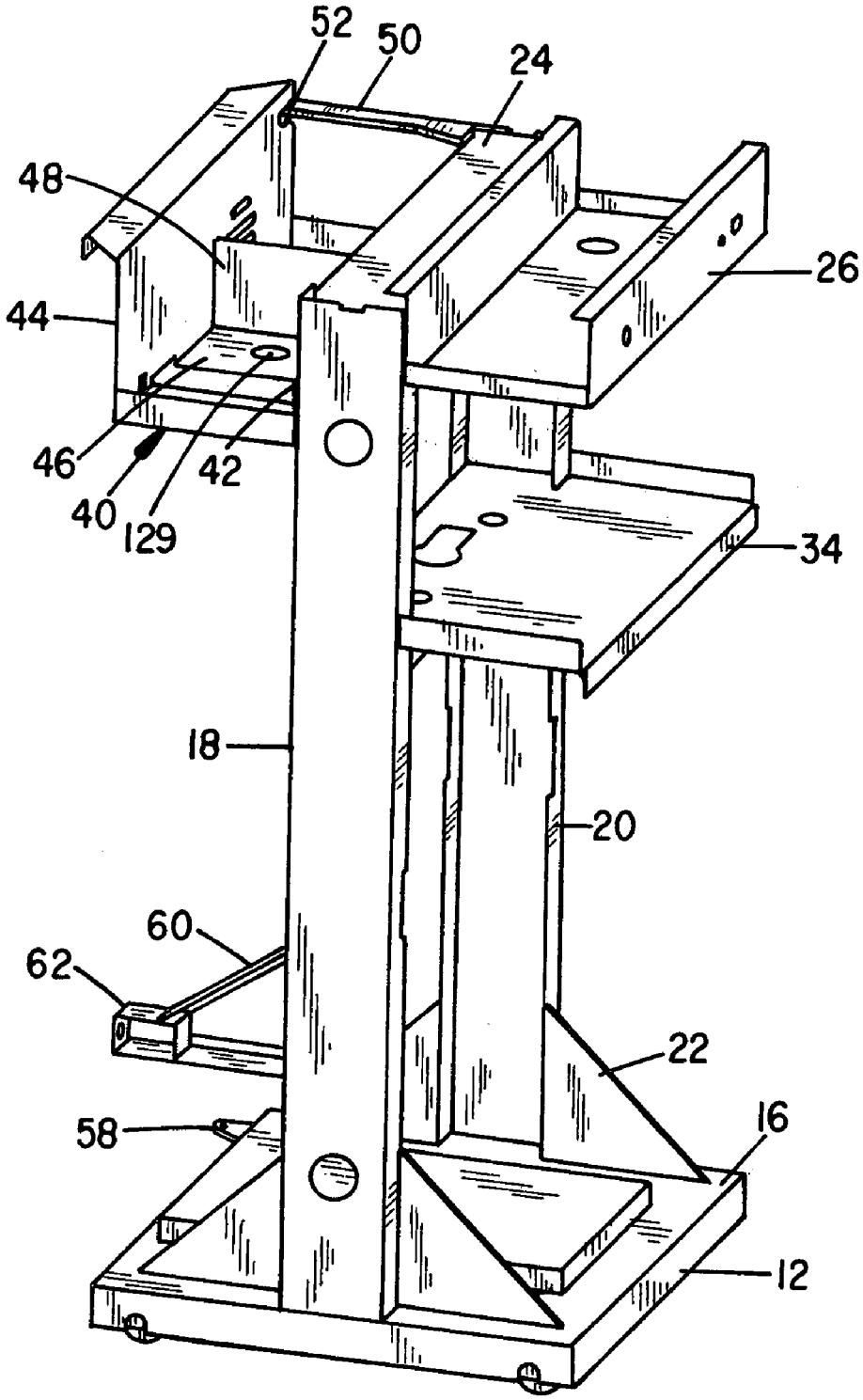
FIG. 4 is an isometric view of the frame structure for the embodiment of FIG. 1.

Referring to the isometric view of the frame assembly shown in FIG. 4, also welded to the vertical channels 18 and 20 at a location proximate the upper ends thereof is a steel tray 40. It has a vertical rear wall 42 affixed to front edge surfaces of the channels 18 and 20 and a vertical front wall 44. The rear and front walls are connected by a horizontal, forwardly projecting floor plate 46. To add additional rigidity to the steel tray 40, a steel plate 48 located approximately midway across the width dimension of the steel tray 40 is welded to the rear plate 42, the front plate 44 and the floor plate 46.

Welded to the rear plate 42 and to the channel 20 at its upper end is a steel arm 50 that passes through a notch 52 formed in the front wall 44. Secured to the arm 50 is a door hinge pin 54, as shown in FIG. 2. A further door hinge pin 56 is affixed to the front edge of the base 12 by a forwardly projecting ear 58. The hinge pins 54 and 56 are vertically aligned with one another, allowing the door 13 to be suspended thereon. The door 13 as well as the skins 11 are preferably fabricated from fiberglass.

The frame structure shown in FIG. 4 also includes a triangular bracket 60 that is welded to the vertical channel 18 and projects forwardly to support a box-like housing 62 in which a door lock assembly is to be contained.

Figure 5:
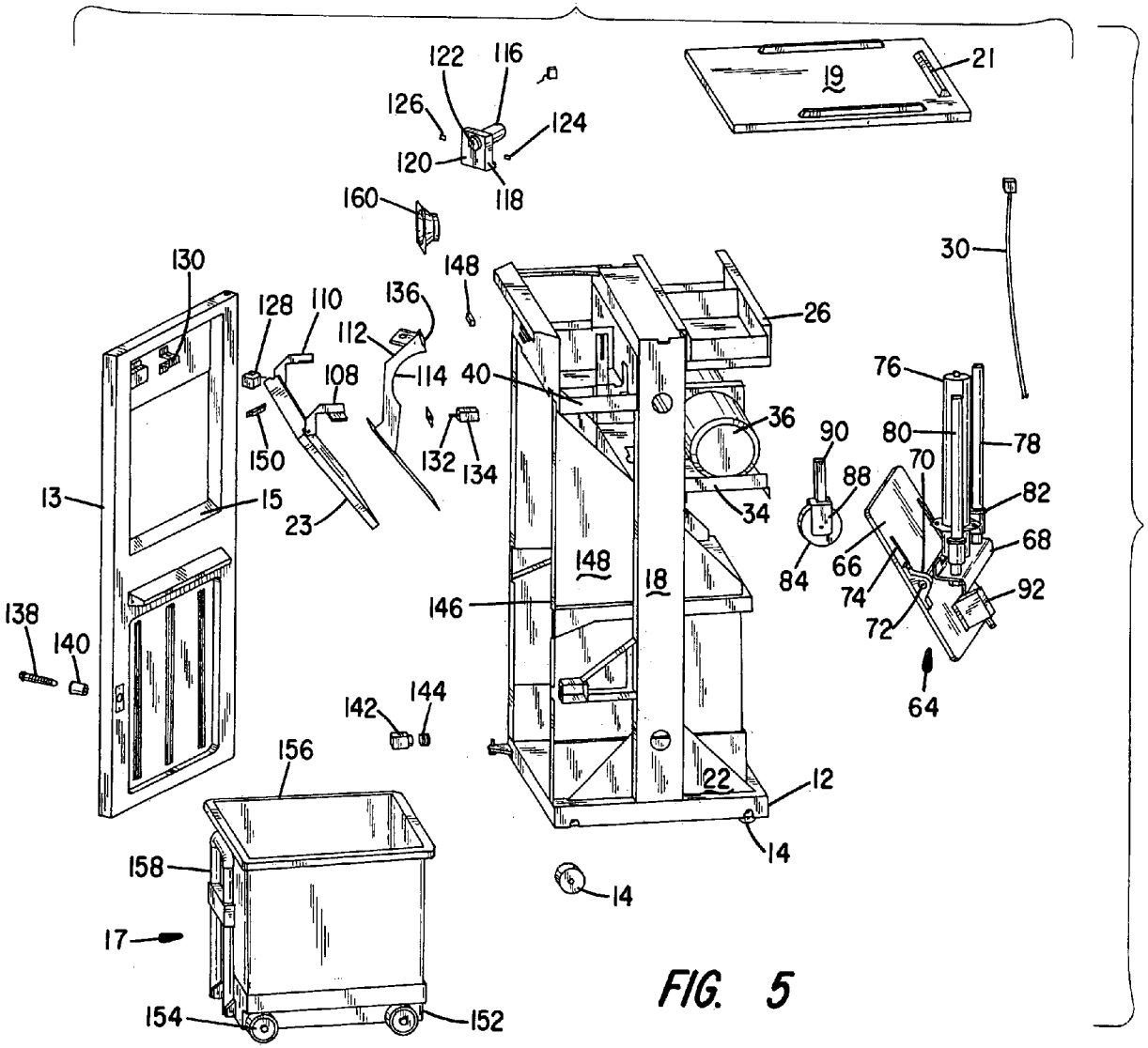
FIG. 5 is an exploded view of the preferred embodiment of FIG. 1.

Referring momentarily to the exploded view of FIG. 5, there is indicated generally by numeral 64 a compaction plate assembly. It includes a cast aluminum plate or platen 66 that is pivotally mounted to a steel channel support member 68. The pivot connection includes a pair of compactor plate bearings 70, disposed midway along the side edges of the compaction plate 66, through which a cylindrical pin 72 extends to allow rotation of the platen 66 about a horizontal axis. A pair of strong, helical springs 74 are mounted on the pivot pin 72. They are operatively disposed between the channel support member 68 and the compaction plate 66 so as to apply a biasing force thereto tending to rotate the compaction plate 66 so that it becomes parallel to the top surface of the channel support member 68, i.e., horizontal, during a compaction stroke, all as will be further described.

With continued reference to the compaction plate assembly 64 of FIG. 5, affixed to the top surface of the channel support member 68 is a hydraulic ram 76. It is centrally disposed between a pair of guide rods 78 and 80. Guide sleeves, as at 82, fit into openings formed through the support tray 34 from which the compaction plate assembly 64 is suspended and serve as bearings for the guide rods 78 and 80. The ram attaches to the top channel 24 and is vertically oriented such that when pressurized by hydraulic fluid from the pump 38 causes the compaction plate to execute a compaction stroke whereby trash deposited in the cart 17 is crushed and compressed.

To avoid having trash deposited on the top surface of the compaction plate 66, it is imperative that the compaction plate be inclined as shown in FIGS. 2 and 3 as waste is being deposited through the door opening 15. However, in order to effect compaction, the plate must assume a horizontal disposition during its downward compaction stroke and return to its inclined disposition at the end of the compaction stroke. To achieve this result, there is provided a relatively large diameter roller 84 that is suspended from a tube 86 of rectangular cross section that is welded to the undersurface of the support plate 34. The roller 84 is journaled for rotation in a U-shaped bracket 88 having a rectangular tube 90 welded to it. The rectangular tube 90 is dimensioned to telescopingly fit within the tubular bracket 86 and held in place by setscrews whereby the degree of extension can be adjusted.

Also attached to the top surface of the compaction plate is a compactor plate pin assembly 92. It is used to releasably lock the platen in a horizontal position during the downward stroke of the platform. As shown in the detailed view of FIG. 6, the compactor plate pin assembly comprises a rectangular block-like housing 94 having laterally extending flanges 96 and 98 with bolt apertures 100 extending through it to permit attachment to the compaction plate. The block 94 includes a bore 102 formed longitudinally therethrough and into which is fitted a locking pin 104 that is provided with a gear rack on an undersurface thereof (not shown). Cooperating with the gear rack on the locking pin 104 is a pinion (not shown) that rotates with an L-shaped lever 106 that is journaled in the housing 94. Rotation of the lever therefore causes reciprocal movement of the pin 104 in the bore 102. The lever 106 is positioned relative to the roller 84 so that as the compaction plate descends from the disposition shown in FIGS. 2 and 3, the pin 104 will be made to project out through the bore 102 at the inner edge of the block 94 to overlay the top surface of the channel 68, thereby locking the compaction plate 66 in its horizontal disposition during the downward movement of the compaction plate assembly, assuring that any objects that may be in the trash being compacted cannot tilt the compaction plate away from its desired horizontal disposition.

Figure 6:
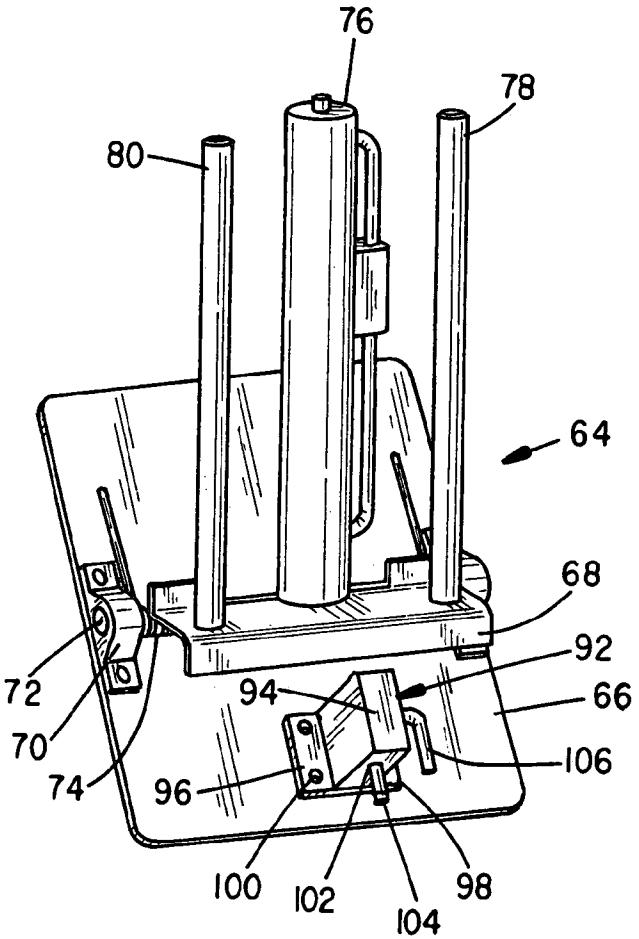
FIG. 6 is a perspective view of the compactor plate assembly used in the embodiment of FIG. 1.

Upon the return stroke, as the compaction plate assembly again rises, a point is reached where the roller 84 again engages the L-shaped lever 106 to thereby move the locking pin 104 to the right when viewed in FIG. 6 whereby the engagement of its far end with the upper surface of the channel 68 no longer pertains. Thus, the continued engagement between the roller 84 and the compaction plate 66 can return the compaction plate to its tilted disposition shown in FIG. 2 against the force of the springs 74.

Returning again to the exploded view of FIG. 5, the hinge panel 23 comprising the waste entry door 23 is pivotally mounted to a pair of door hinge arms 108 and 110 which fasten by screws to the floor plate 46 (FIG. 4) of the steel tray 40. Fastened to the inside surface of the hinge panel 23 is a door motion arm 112 that has an arcuate cam profile 114 formed therein along its length dimension. Also mounted on the floor plate 46 of the tray 40 is a door actuating motor 116 which is coupled through a gear box 118 to one end of an arm 120 supporting a cam follower roller 122 on the free end thereof. The arm 120 is joined to an output shaft of the gear box 118, as is a further cam (not shown). This further cam cooperates with Microswitches® 124 and 126 which are connected in circuit with the motor 116 to cause the arm 120 to be rotated 180° upon each actuation of the motor.

The roller 122 is positioned to cooperate with the arcuate surface 114 on the arm 112 so as the arm moves through 180°, the waste entry door swings open to the position shown in FIGS. 2 and 3, allowing waste to be dumped into the cart 17. Because the platform of the compaction plate assembly is inclined, it does not interfere with the opening of the hinged panel waste entry door 23.

Figure 7:
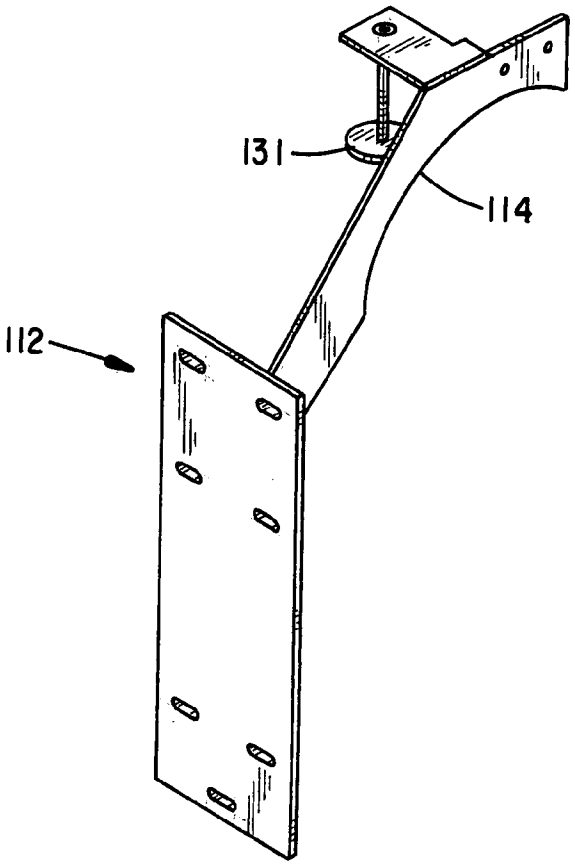
FIG. 7 is a detailed view of the door motion arm that is attached to the waste entry door.

The actuation of the motor 116 is controlled by a commercially available motion sensor 128 that mounts to a bracket 130 on an upper rear surface of the main entry door 13. Thus, when the door 13 is closed and locked, as a patron approaches the waste compactor 10, the motion is detected and a signal is sent to the motor 116 to initiate a 180° swing of arm 120 to first open the waste entry door 23. As the patron moves away after depositing refuse into the compactor, the action is again sensed and the motor 116 is triggered to rotate the arm an additional 180°, allowing the waste entry door 23 to reclose. To prevent the door 23 from bouncing upon closure thereof, a permanent magnet 129 is mounted on the tray 46 (FIG. 4) that attracts a ferrous metal disk 131 that is suspended by a threaded rod from an appendage on the arm 112 as shown in FIG. 7.

A programmable logic array comprising the electronic circuit 28 is configured to initiate a compaction cycle after a predetermined number of openings of the waste entry door 23. For example, and without limitation, the electronic circuit may be programmed such that 10 patrons approaching and depositing refuse into the cart 17 will initiate a compaction cycle whereby that refuse is compressed into a cube defined by the side walls of the cart 17.

To prevent the waste entry door 23 from opening during the compaction cycle, which might expose a patron to injury, an interlock is provided to block the waste entry door 23 from opening during a compaction cycle. Specifically, a solenoid 132 is mounted on a rear surface of the rear end plate 42 of the steel tray 40 with the solenoid plunger 134 extending through a hole drilled in that plate. When the solenoid is energized, the plunger 134 extends in a forward direction to overlay and interfere with a stop bracket 136 that is affixed to swing arm 112 to which the waste entry door 23 attaches. The pin on the solenoid thus blocks the waste entry door 23 from being swung open so long as the solenoid 132 is energized. At the completion of the compaction stroke and return of the compaction plate to its elevated and tilted disposition, the solenoid is deenergized, retracting the pin 134, thus allowing swinging movement of the waste entry door under control of the motor assembly 116.

The door lock for securing the door 13 preferably comprises a socket head bolt 138 that is designed to pass through a sleeve 140 that is mounted in the door 13. The bolt 138 is sufficiently long to project through the thickness dimension of the door 13 and into a threaded block 142 designed to fit within the triangular bracket 60. The block 142 is urged forward within the confines of the box-like housing 62 by a helical spring 144. Using an Allen wrench, the bolt 138 may be rotated to draw the door 13 against the vertical edge 146 of the inner wall 148 disposed in the frame and preventing the door 13 from being opened by persons not having an appropriate Allen wrench.

To prevent actuation of the compaction plate assembly if the door 13 is open, a magnetic proximity switch of a well-known type has its switch contact member 148 fastened to the front wall 44 of the steel tray 40 at a position where it will be actuated when a magnet 150 that is affixed to the inside surface of the main door panel 13 is brought into close proximity to it. Thus, only when the door is closed will the switch contacts of the magnetic switch 148 be closed to permit the motor 36 driving the hydraulic pump to run.

The cart 17 includes a base tray 152 mounted on wheels 154 and supported on the base tray is a separable trash-receiving chamber 156. The chamber 156 has four mutually perpendicular sidewalls, an open top and an open bottom. For convenience, a polyethylene bag may be inserted into the chamber 156 for ultimately containing the trash once impacted. A pull handle 158 is pivotally attached to the base 152 to facilitate removing a filled and compacted mass of waste material through the open door 13 and to a temporary storage site. Once at the storage site, the tube-defining chamber 156 can be lifted free of the tray 152, leaving a compacted trash-filled bag for ultimate disposal by a trash hauling company.

It has also been found desirable to mount an audible speaker 160 to the front wall 44 of the steel tray 40 where the speaker is coupled by wires to a voice chip integrated circuit on the electronics panel 28. As in many telephone answering machines, these voice chips may be used to store several short audio messages that are played each time a patron causes the waste entry door 23 to swing open as a marketing tool. The messages may thank the patron for visiting the restaurant or for dumping his/her trash, etc.

Figure 9:
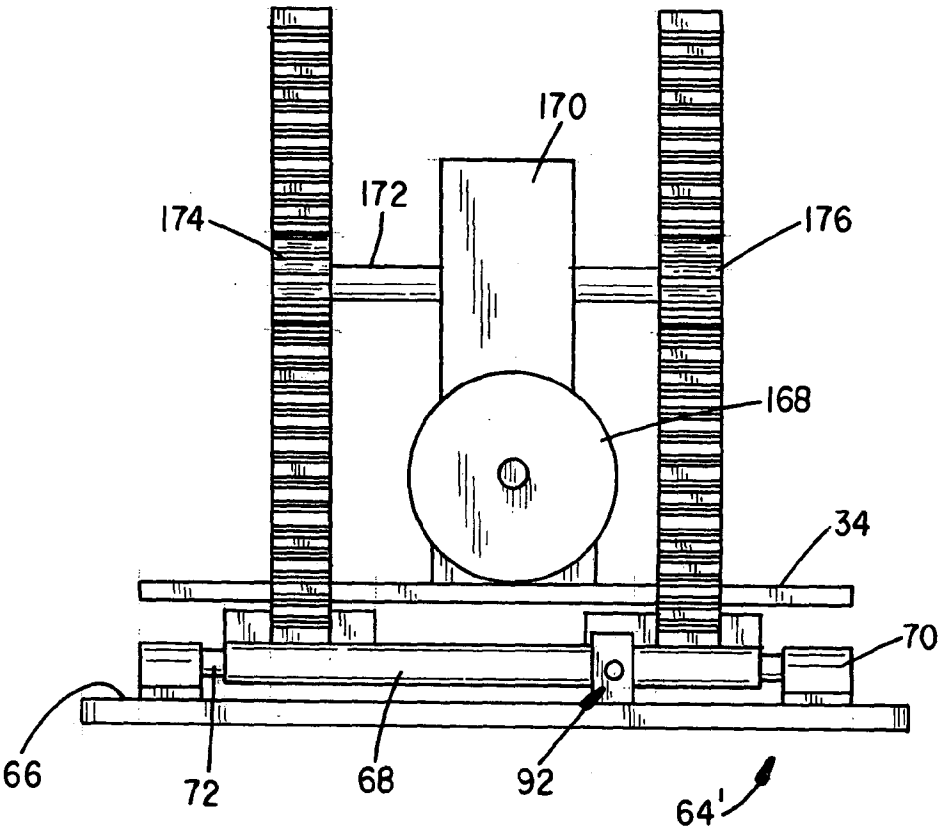
FIG. 9 is a partial view of the compaction assembly of FIG. 8 showing the drive mechanism.
Figure 8:
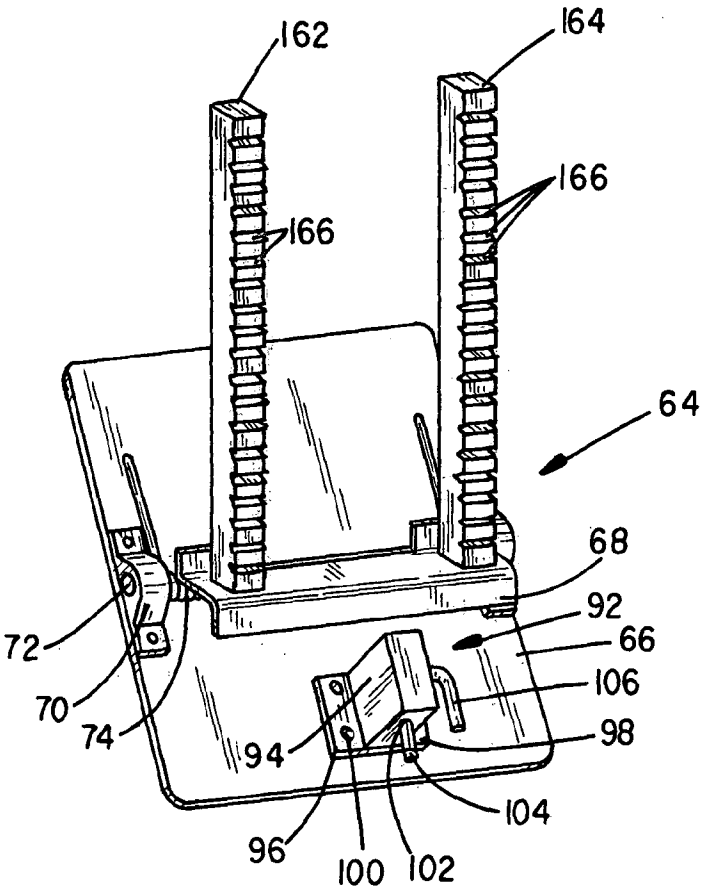
FIG. 8 is an alternative embodiment of a compaction plate drive assembly.

This invention has been described herein in considerable detail in order to comply with the patent statutes and to provide those skilled in the art with the information needed to apply the novel principles and to construct and use such specialized components as are required. However, it is to be understood that the invention can be carried out by specifically different equipment and devices, and that various modifications, both as to the equipment and operating procedures, can be accomplished without departing from the scope of the invention itself. For example, satisfactory performance has been achieved when the hydraulic ram 76 has been eliminated, along with its associated hydraulic pump and associated hydraulic lines, and replaced with a mechanical drive. As shown in FIG. 8 the cylindrical guide rods 78 and 80 seen in FIG. 6 have been replaced by elongated bars 162 and 164 and the rectangular bars have a gear rack 166 formed longitudinally there along. An electric motor 168 (FIG. 9) is affixed to the support tray 34 and its output shaft is coupled through a gearbox 170 to an output shaft 172 on which pinion gears 174 and 176 are keyed. Upon command from the devices' programmable logical ray to initiate a compaction stroke, the motor 168 is energized, thereby driving the pinion gears 174 and 176 on the rack surfaces 166 of the guide rods 162 and 164 to cause the compaction plate to descend and later ascend. The compaction plate assembly of FIGS. 8 and 9 is otherwise identical to that of FIG. 6 whereby the locking of the compaction plate in a horizontal disposition and a subsequent release thereof to allow it to assume and inclined disposition is the same as has already been explained.

What is claimed is:

1. A refuse compactor for a restaurant facility comprising:

(a) a frame comprising a horizontal rectangular base and a pair of upwardly extending structural members affixed to the base along opposed side edges thereof;

(b) a horizontal cross member extending between the pair of structural members at upper ends thereof;

(c) a compaction plate assembly including a one-piece platen pivotally affixed to a support member for rotation about a horizontal axis, a compaction plate driver operatively disposed between said horizontal cross member and said support member for driving the platen in a vertical direction toward and away from said base;

(d) means for pivoting the platen from a first position inclined to the vertical to a second horizontal position during a downward movement of the compaction plate assembly and returning the platen to the inclined position during an upward movement of the compaction plate assembly; and (e) an extendable and retractable locking pin device carried by the platen and adapted to be selectively operatively coupled to and uncoupled from the support member for locking the platen in its horizontal position during the downward movement of the platen and releasing the platen during the upward movement.

2. The refuse compactor as in claim 1 and further including:

(a) means for biasing the platen toward the second horizontal position.

3. The refuse compactor of claim 1 and further including an enclosure mounted on said base, the enclosure including a pair of sidewalls joined to one another by a rear wall and a door member hinged to the frame about a vertical axis and adapted to form a front wall of the enclosure when the door member is parallel to the rear wall, said door member including a refuse receiving opening formed through it.

4. The refuse compactor of claim 3 and further including a hinged panel pivotable about a horizontal axis for selectively blocking the refuse-receiving opening.

5. The refuse compactor as in claim 4 and further including means for automatically pivoting the hinged panel to unblock the refuse-receiving opening.

6. The refuse compactor as in claim 4 and further including an electric motor operatively coupled to the hinged panel for pivoting the hinged panel to unblock the refuse receiving opening upon activation of the motor; and a motion sensor mounted on the door for initiating activation of the motor upon approach of a patron of the restaurant facility within a predetermined distance of the refuse compactor.

7. The refuse compactor as in claim 5 wherein said means for automatically pivoting the hinged panel places the hinged panel generally parallel to the platen when the platen is in the first position.

8. The refuse compactor as in claim 5 and further including means for preventing movement of the hinged panel from an opening blocking position during movement of the compaction plate assembly.

9. The refuse compactor as in claim 3 and further including an electrical switch for preventing operation of the compaction plate driver when the door member is ajar.

10. The refuse compactor as in claim 6 and further including means for playing an audio message upon actuation of the electric motor.

11. The refuse compactor as in claim 1 and further including a wheeled cart adapted to sit on the rectangular base, the cart supporting a removable container into which refuse can be deposited and compacted.

12. The refuse compactor as in claim 9 wherein the compaction plate driver includes a hydraulic ram, an electric motor and a hydraulic pump driven by the electric motor with the hydraulic pump being connected to the hydraulic ram and the electrical switch being connected in circuit with the electric motor.

13. The refuse compactor as in claim 9 wherein the compaction plate driver includes a pair of guide rails pivotally joined to the compaction plate, the guide rails having a gear rack on an exterior surface thereof, an electric motor-driven gear box having an output shaft and pinion gears affixed to the output shaft and engaging the gear rack on the pair of guide rails; and the electrical switch being connected in circuit with the electric motor.

* * * * *